United States Patent [19]

Fisher et al.

[11] 4,041,625

[45] Aug. 16, 1977

[54] GUIDE RAIL ASSEMBLY FOR THE EJECTOR OF A SCRAPER AND METHOD

[75] Inventors: George A. Fisher; Warner G. Richardson, both of Joliet, Ill.

[73] Assignee: Caterpillar Tractor Co., Peoria, Ill.

[21] Appl. No.: 752,709

[22] Filed: Dec. 20, 1976

[51] Int. Cl.[2] ..... B60P 1/36; E02F 9/28

[52] U.S. Cl. ..... 37/126 AE; 29/400 M; 214/82; 37/129

[58] Field of Search ..... 37/124 R, 126 R, 126 AE, 37/126, 129, 126 AB; 29/400 R, 400 M, 428, 455 R; 214/82 R

[56] References Cited

U.S. PATENT DOCUMENTS

| | | | |
|---|---|---|---|
| 3,247,984 | 4/1966 | Gregory, Sr. et al. | 214/82 |
| 3,352,439 | 11/1967 | Hardwick | 37;214/126 AE;82 |
| 3,488,870 | 1/1970 | Holets et al. | 214/82 X |
| 3,799,374 | 3/1974 | Weaver | 214/82 |
| 3,827,753 | 8/1974 | Pitts | 214/82 X |
| 3,931,687 | 1/1976 | Johns, Jr. | 37/126 AE |

*Primary Examiner*—E. H. Eickholt
*Attorney, Agent, or Firm*—Phillips, Moore, Weissenberger, Lempio & Majestic

[57] ABSTRACT

A scraper comprises a bowl structure having an ejector assembly reciprocally mounted thereon for selectively discharging material forwardly of the bowl structure. In one embodiment of this invention, a guide rail assembly is secured interiorly on each sidewall of the bowl structure to engage a guide roller, rotatably mounted on the ejector, for guiding the same during its movements in the bowl. Each guide rail assembly comprises a cylindrical guide rod secured on a respective sidewall by a pair of locating rods disposed on either side of the guide rod and welded between the guide rod and the sidewall. The guide rod is secured to the sidewall of the bowl structure by placing a first linear portion thereof adjacent to the sidewall and then placing first linear portions of the locating rods on either side of the guide rod to space it from the sidewall at a first predetermined distance. This procedure is followed along the entire lengths of the guide and locating rods to compensate for any irregularities that may be formed in the sidewall whereafter the located rods are welded between the guide rod and the sidewall. In a second embodiment of this invention, the guide rail assemblies are secured to a push frame of the bowl structure to engage guide rollers rotatably mounted on a rearward extension of the ejector assembly.

17 Claims, 4 Drawing Figures

GUIDE RAIL ASSEMBLY FOR THE EJECTOR OF A SCRAPER AND METHOD

BACKGROUND OF THE INVENTION

This invention relates to a guide rail assembly secured to a scraper bowl structure to engage a roller rotatably mounted on an ejector assembly, reciprocally mounted on the bowl structure, and a method for forming the guide rod assembly. Conventional scrapers of this type normally comprise a guide rail secured interiorly of a sidewall of a scraper bowl to engage and track the roller during reciprocal movements of the ejector in the scraper bowl. A pair of carrier rollers are also mounted on a lower end of the ejector to engage wear strips secured to the bottom wall of the scraper to cooperate with the guide rollers to precisely guide the ejector. A re-occurring problem with this type of guide rail is one of compensating for irregularities formed in the sidewalls of the scraper bowl whereby the guide rollers may be placed out of contact with respect to the guide rails during movement of the ejector.

SUMMARY OF THE INVENTION

The present invention is directed to overcoming the problem as set forth above.

According to the present invention, a guide rail assembly is provided for maintaining substantial contact with a roller, rotatably mounted on an ejector assembly, throughout the entire length of travel of the ejector assembly on a scraper bowl structure. The guide rail assembly comprises an elongated guide rod having a first cross sectional area and a pair of elongated locating rods disposed on either side of the guide rod. Each of the locating rods has a second cross sectional area substantially less than the cross sectional area of the guide rod and the locating rods are secured between the guide rod and the bowl structure.

In carrying forth the method steps of this invention, a first linear portion of the guide rod is placed adjacent to a first portion of the bowl structure, first linear portions of the locating rods are placed on either side of the first linear portions of the guide rod to space the guide rod at a first predetermined distance from the bowl structure, a second linear portion of the guide rod is placed adjacent to a second portion of the bowl structure, second linear portions of the locating rod are placed on either side of the second linear portion of the guide rod to space the guide rod at a second predetermined distance from the bowl structure and each of the locating rods is then secured between the guide rod and the bowl structure. Thus, the distance between the guide rod and bowl structure may be varied throughout the entire length of the guide rod to compensate for any irregularities that may be formed in the bowl structure to insure substantial rolling contact between the rollers of the ejector assembly and the guide rod throughout the entire length of travel of the ejector assembly on the scraper bowl structure.

BRIEF DESCRIPTION OF THE DRAWINGS

Other objects of this invention will become apparent from the followng description and accompanying drawings wherein.

DETAILED DESCRIPTION

Figure 1:
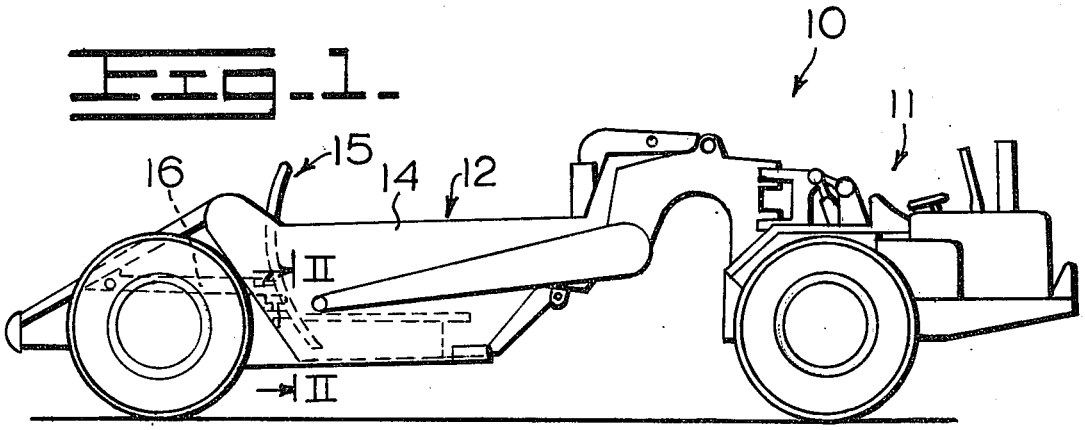
FIG. 1 is a side elevational view of a wheel tractor-scraper having an ejector assembly reciprocally mounted thereon.

FIG. 1 illustrates a wheel tractor-scraper 10 comprising a tracter 11 attached to a bowl structure 12 by a pair of laterally spaced draft arms 13 (one shown). The scraper bowl structure comprises a pair of laterally spaced sidewalls 14 (one shown) and an ejector assembly 15 reciprocally mounted in the bowl structure for movement between rearward and forward ends thereof under control of a double-acting hydraulic cylinder 16. During movements of the ejector assembly in the bowl structure, the ejector assembly is guided by a plurality of rollers attached to the ejector thereof, including a pair of guide rollers 17, one of which is shown in FIG. 2.

Figure 2:
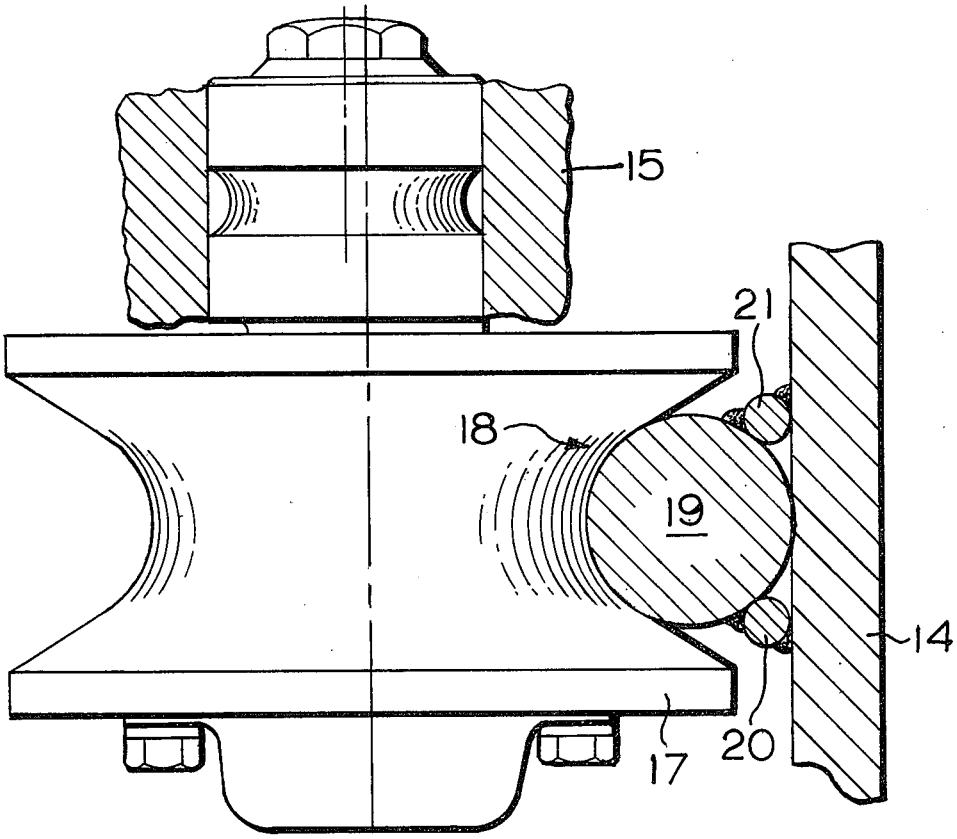
FIG. 2 is an enlarged cross sectional view of a guide rail assembly secured to a sidewall of a bowl of the scraper and engaging a guide roller rotatably mounted on the ejector assembly, the view being taken generally in the direction of arrows II—II in FIG. 1.

As further shown in FIG. 2, the roller engages an elongated guide rail assembly 18 secured interiorly on sidewall 14. The guide rail assembly is duplicated on the opposite sidewall of the scraper bowl. The guide rail assembly comprises an elongated guide rod 19 and a pair of elongated locating rods 20 and 21 disposed on either side of the guide rod to preferably contact the guide rod and sidewall 14.

Each of the locating rods is welded or otherwise suitably secured to the guide rod and to the sidewall. The cross sections of the guide and locating rods are preferably cylindrical and each locating rod has a cross sectional area which is substantially less than that of the guide rod. In one application, for example, the locating rod had a diameter closely approximating 1.6 cm. Whereas the guide rod had a diameter closely approximating 5 cm.

A recurring problem in securing a conventional guide rail to the sidewall of a scraper bowl is one of compensating for irregularities formed in the sidewall during fabrication thereof. In particular, certain portions of the guide rail may be maintained out of contact with roller 17 to create potential binding and stabilization problems. The above described guide rail assembly 18 and the hereinafter described method for making the same substantially alleviate such problem.

Figure 3:
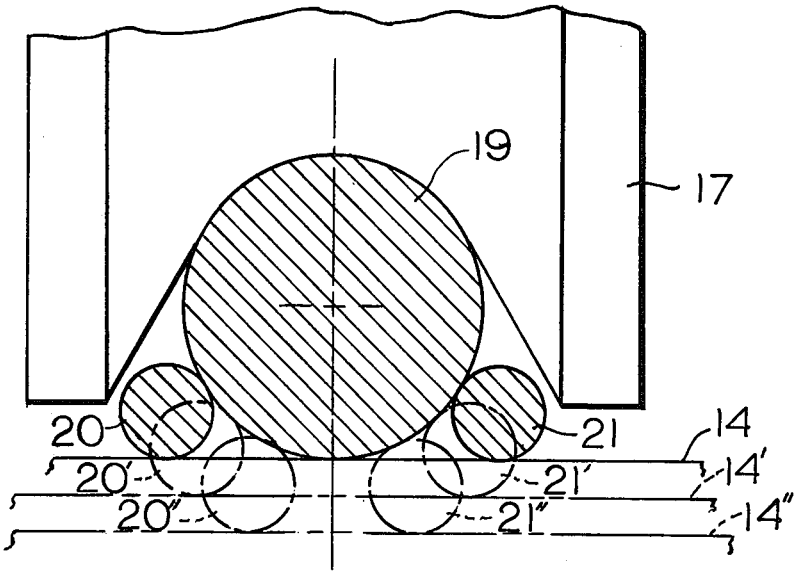
FIG. 3 is an enlarged cross sectional view schematically illustrating various positions of a guide rod of the guide rail assembly relative to the sidewall of the scraper bowl.

In carrying forth the method steps of this invention, a suitable jig and fixture may be employed to place a first linear portion of guide rod 19 adjacent to a first portion of sidewall 14, schematically illustrated in FIG. 3. First linear portions of locating rods 20 and 21 are placed on either side of the first linear portions of guide rod 19 to space the guide rod at a first predetermined distance from the sidewall. In FIG. 3, such initial distance may equal "zero" for illustration purposes, i.e., guide rod 19 contacts sidewall 14.

When the workman progresses along the guide and locating rods, he may find an irregularity or concavity in second portions 14' of the sidewall whereby a second linear portion of guide rod 19 must be placed at a second predetermined distance from the sidewall. Second linear portions 20' and 21' of the locating rods are thus bent or flexed inwardly into the bowl and placed on either side of the second linear portion of the guide rod to compensate for such irregularity in the sidewall, i.e., rod portions 20 and 21 are separated apart at a greater distance than rod portions 20' and 21'. It should be understood that the guide and locating rods may be composed of a suitable steel material or the like exhibiting sufficient flexibility to permit bending thereof into their desired locations adjacent to the sidewall.

FIG. 3 further illustrates a third portion 14'' of the sidewall which has a greater depression formed therein whereby third linear portions 20'' and 21'' of the locating rods may be placed under a third linear portion of the guide rod to locate it at a third predetermined and greater distance from the sidewall than the aforementioned distances. The locating rods may be sequentially welded to the sidewall during each of the above positioning steps or, alternatively, welded in place after the entire lengths of the guide and locating rods have been properly positioned adjacent to the sidewall. It should be understood that rods 19, 20 and 21 are preferably circular in cross section but may comprise other cross sectional configurations, e.g., square. Furthermore, although guide rod 19 is shown as being solid, it should be understood that it could be formed as a tube and yet exhibit the structural and functional desiderata described above.

Figure 4:
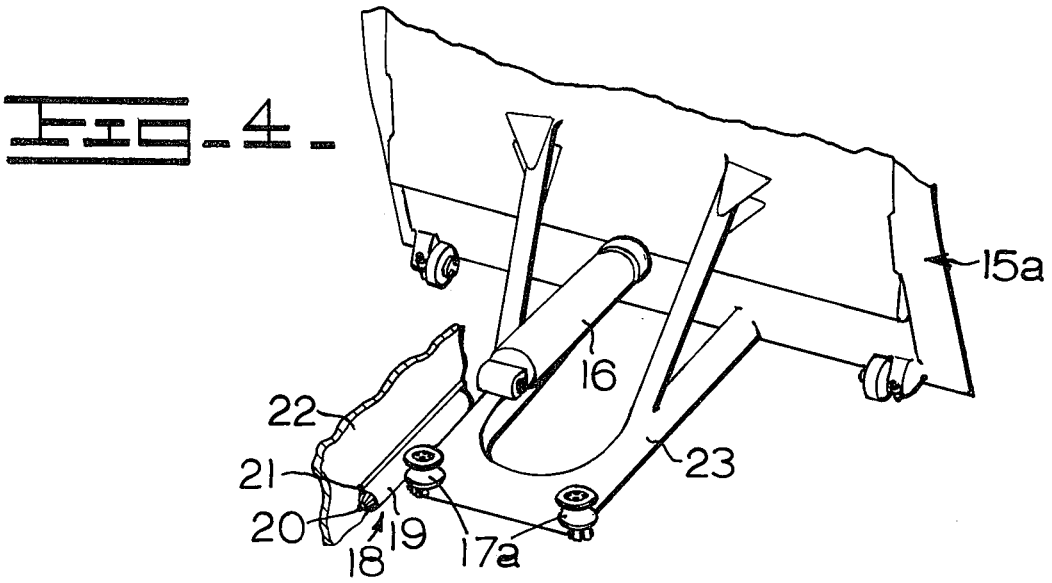
FIG. 4 partially illustrates an ejector assembly with the guide rail assembly of this invention secured on a push frame to guide the same.

FIG. 4 illustrates a relocation of guide rail assembly 18, externally of the scraper bowl proper. In particular, guide rod 19 and locating rods 20 and 21 are secured on a push frame, partially illustrated at 22 and secured reawardly on the bowl structure of the scraper to form an integral part thereof. A pair of guide rollers **17*a* are rotatably mounted on a rearward extension 23 of an ejector assembly 15*a* to each engage a respective guide rod 19** (one shown). The guide rail assemblies are secured to the push frame in substantially the same manner as described above.

The embodiments of the invention in which an exclusive property or privilege is claimed are defined as follows:

1. In a scraper of the type comprising a bowl structure, an elongated guide rail assembly secured on said bowl structure, an ejector assembly reciprocally mounted on said bowl structure for reciprocal movement thereon, and a guide roller rotatably mounted on said ejector assembly and engaging said guide rail assembly for guiding reciprocal movements of said ejector assembly on said bowl structure, the invention wherein said guide rail assembly comprises an elongated guide rod having a first cross sectional area and a pair of elongated locating rods disposed on either side of said guide rod and each having a second cross sectional area substantially less than said first cross sectional area and securing said guide rod to said bowl structure.

2. The scraper of claim 1 wherein said locating rods are each welded to said guide rod and to said bowl structure.

3. The scraper of claim 1 wherein said guide rod has a circular cross section.

4. The scraper of claim 3 wherein each of said locating rods has a circular cross section.

5. The scraper of claim 1 wherein said locating rods each contact said guide rod and said bowl structure.

6. The scraper of claim 1 wherein a first linear portion of said guide rod contacts said bowl structure and wherein a second linear portion of said guide rod remote from the first portion thereof is maintained out of contact with respect to said bowl structure at a predetermined distance by said locating rods.

7. The scraper of claim 6 wherein first linear portions of said locating rods engaging the first linear portion of said guide rod are separated apart at a greater distance than second linear portions of said locating rods engaging the second linear portion of said guide rod.

8. The scraper of claim 1 wherein said bowl structure comprises a bowl having a pair of laterally spaced sidewalls and wherein said ejector assembly comprises an ejector reciprocally mounted in said bowl for movement between rearward and forward ends thereof.

9. The scraper of claim 8 wherein a said guide rail assembly is secured interiorly on each of said sidewalls and wherein a said guide roller is rotatably mounted on each lateral side of said ejector.

10. The scraper of claim 8 wherein said bowl structure further comprises a push frame secured to said bowl and having said guide rail assembly secured thereon and wherein said ejector assembly comprises a rearward extension having said guide roller rotatably mounted thereon.

11. A method for mounting a guide rail assembly on a bowl structure adapted to have an ejector reciprocally mounted thereon comprising the steps of placing a first linear portion of an elongated guide rod, having a first cross sectional area, adjacent to a first portion of said bowl structure, placing first linear portions of a pair of elongated locating rods, each having a second cross sectional area substantially less than said first cross sectional area, on either side of the first linear portion said guide rod to space said guide rod at a first predetermined distance from said bowl structure, placing a second linear portion of said guide rod adjacent to a second portion of said bowl structure, placing second linear portions of said locating rods on either side of the second linear portion of said guide rod to space said guide rod at a second predetermined distance from said bowl structure, and securing each of said locating rods to said guide rod and to said bowl structure.

12. The method of claim 11 wherein said securing step comprises welding each of said locating rods between said guide rod and said bowl structure.

13. The method of claim 11 wherein the steps of placing first and second linear portions of said guide rod adjacent to said bowl structure each comprise placing a guide rod having a circular cross section adjacent to said bowl structure.

14. The method of claim 11 wherein the step of placing first linear portions of said locating rods on either side of the first linear portion of said guide rod comprises separating the first linear portions of said locating rods at a greater distance from each other than the distance separating the second linear portions of said locating rods.

15. The method of claim 11 wherein the steps of placing first and second linear portions of said locating rods on either side of said guide rod each comprise contacting said locating rods with said guide rod and with said bowl structure.

16. The method of claim 11 wherein said bowl structure comprises a scraper bowl having a pair of laterally spaced sidewalls and wherein said securing step comprises the step of securing said locating rods interiorly on each one of said sidewalls.

17. The method of claim 11 wherein said bowl structure comprises a scraper bowl and push frame secured rearwardly on said scraper bowl and wherein said ejector has a rearward extension thereon, said securing step comprising the step of securing said locating rods on said push frame.

* * * * *